United States Patent [19]

Zaugg

[11] Patent Number: 5,039,042

[45] Date of Patent: Aug. 13, 1991

[54] ARRANGEMENT FOR ATTACHING A WATCH CASE TO A SUPPORT

[75] Inventor: Hans Zaugg, Derendingen, Switzerland

[73] Assignee: ETA SA Fabriques d'Ebauches, Grenchen, Sweden

[21] Appl. No.: 183,966

[22] Filed: Apr. 20, 1988

[30] Foreign Application Priority Data

May 11, 1987 [CH] Switzerland ..... 01708/87

[51] Int. Cl.[5] ..... A47F 7/00

[52] U.S. Cl. ..... 248/115; 248/288.3

[58] Field of Search ..... 248/114–116, 248/481, 288.5, 288.3; 403/141, 142, 176, 122

[56] References Cited

U.S. PATENT DOCUMENTS

| | | | |
|---|---|---|---|
| 76,706 | 4/1868 | Brevoort | 248/288.3 X |
| 317,132 | 5/1885 | Headington | 403/122 X |
| 1,556,963 | 10/1925 | Rumberger | 248/115 |
| 1,906,630 | 5/1933 | Hodney | 248/115 |
| 1,924,997 | 8/1933 | Hodney | 248/115 |
| 2,527,090 | 10/1950 | Bauman | 248/114 |
| 2,617,464 | 11/1952 | Trumbull | 403/122 X |
| 2,752,726 | 7/1956 | Calverley | 403/142 X |
| 4,597,354 | 7/1986 | Gelula | 403/141 X |

FOREIGN PATENT DOCUMENTS

| | | | |
|---|---|---|---|
| 198143 | 6/1958 | Austria | 403/141 |
| 8311770 | 10/1983 | Fed. Rep. of Germany . | |
| 618668 | 3/1927 | France . | |
| 77128 | 7/1918 | Switzerland . | |
| 2161534 | 1/1986 | United Kingdom | 248/288.3 |
| 2178566 | 11/1987 | United Kingdom . | |

*Primary Examiner*—Alvin C. Chin-Shue

*Attorney, Agent, or Firm*—Griffin, Branigan & Butler

[57] ABSTRACT

In this invention a watch case is attached to a support by means of an arrangement permitting separation of the case from its support whenever desired. To this effect the case includes a projection in the form of a bracket the riser of which is fastened to the case and the cross member is hollowed out to provide a spherical housing extended by two holes the diameters of which are less than that of the spherical housing. The frontal face of the cross member is provided with a slot. The support is equipped with a stem terminating in a ball. The ball is dimensioned in order that it may be forced into the spherical housing within which it may move freely with a slight amount of play. This attaching system enables coupling a pocket watch to a chain as well as a watch to a display support.

3 Claims, 3 Drawing Sheets

ARRANGEMENT FOR ATTACHING A WATCH CASE TO A SUPPORT

This invention concerns an arrangement for attaching a watch case to a support in such a fashion that the case may readily be separated from such support.

BACKGROUND OF THE INVENTION

A large number of solutions to the problem of attaching a watch and particularly a pocket watch to a support have already been advanced. By support one here understands all means which may be foreseen for retaining or fastening a watch to an object which could be for instance a presentation support, a watch holder, a stand or simply a chain hooked to a costume. To this end there has often been employed the pendant of the watch which takes the form of a buckle hinged to a part which projects from the case. These known solutions have for many years generally been applied to metallic watch cases. The present utilization of plastic materials in order to form the watch case leads however to new forms wherein the classic pendant would be inelegant or would appear to be an anachronism.

Thus the main purpose of this invention is to provide a new system for attaching a watch case to a support, such support being extremely simple, of low cost and easy to use. The proposed system also enables utilization of different supports, themselves fulfilling different functions and this on the basis of an attaching arrangement which is the same for all foreseen utilizations.

SUMMARY OF THE INVENTION

In order to arrive at the fulfillment of this purpose there is provided an arrangement for attaching a watch case to a support adapted in a manner such that the case may be separated from such support whenever desired, said case comprising a projection in the form of a bracket the riser of which is fastened to the case and the cross member of which is hollowed out to provide a spherical housing communicating respectively with the top and the bottom of said cross member by first and second coaxial cylindrical holes, the diameters of said first and second holes being chosen to be substantially smaller than that of the spherical housing, the frontal face of said cross member being furthermore provided with a slot opening respectively into the spherical housing and into the first and second cylindrical holes, the support being equipped with a stem terminating in a ball, said stem being dimensioned so as to be capable of being introduced into said slot and said ball being dimensioned so that it may be forced into said spherical housing, and thereafter move freely therein, the diameter of said ball being substantially greater than the diameters of said first and second cylindrical holes.

The invention will now be explained through the description which follows having reference to the drawings which illustrate it by way of example.

DESCRIPTION OF THE PREFERRED EMBODIMENT

Figure 1:
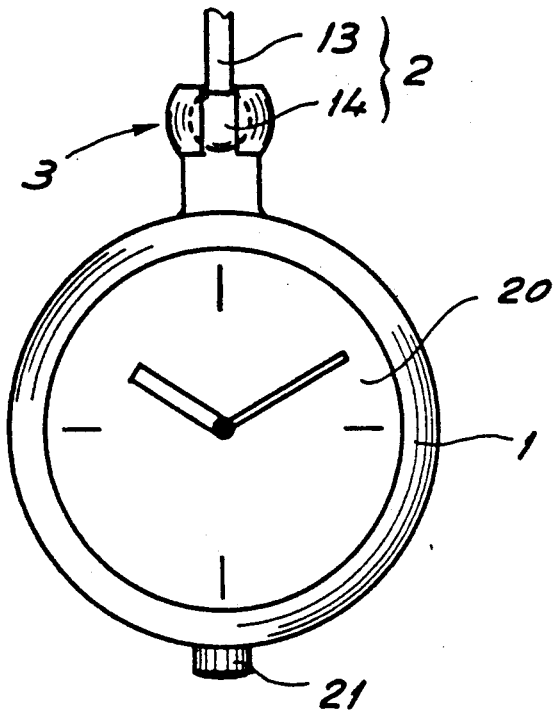
FIG. 1 is a plan view of a pocket watch provided with the attaching arrangement according to the invention.

FIG. 1 shows a pocket watch, the movement 20 of which forms an integral part of case 1. A winding crown 21 is shown. The attaching arrangement is located on the side opposite the crown and bears references 2 and 3.

Figure 2:
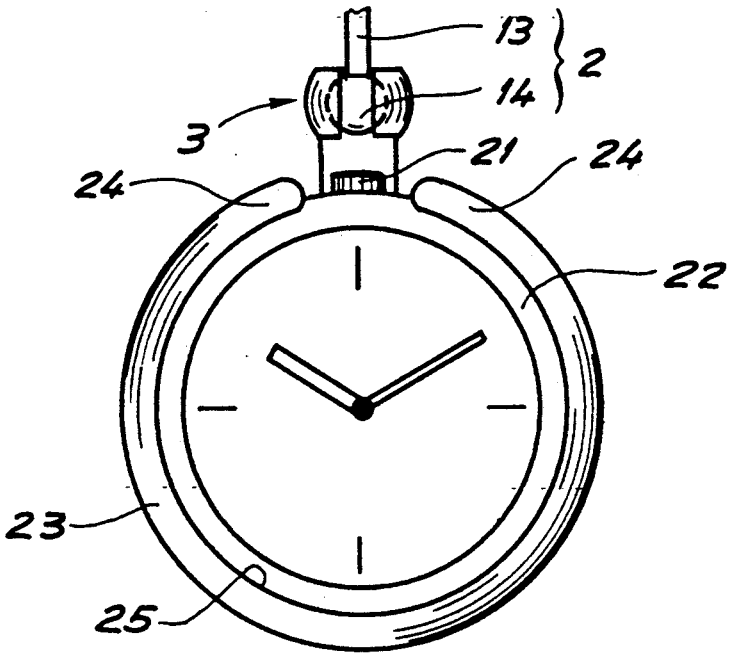
FIG. 2 is a plan view of a watch placed in a receptacle itself equipped with the same arrangement as that which has been shown on FIG. 1.

FIG. 2 is a plan view of a watch 22 provided with a crown 21 such watch being retained in a receptacle 23. The receptacle is provided with elastic flanges 24 which hold the watch gripped in a housing 25. In spreading flanges 24 and in exerting pressure with a finger through a hole (not shown) which is located at the center of the receptacle, one may remove the watch from its housing. In this form the attaching arrangement 3 is no longer fixed to the watch case itself, but to the receptacle receiving such watch case.

Figure 3:
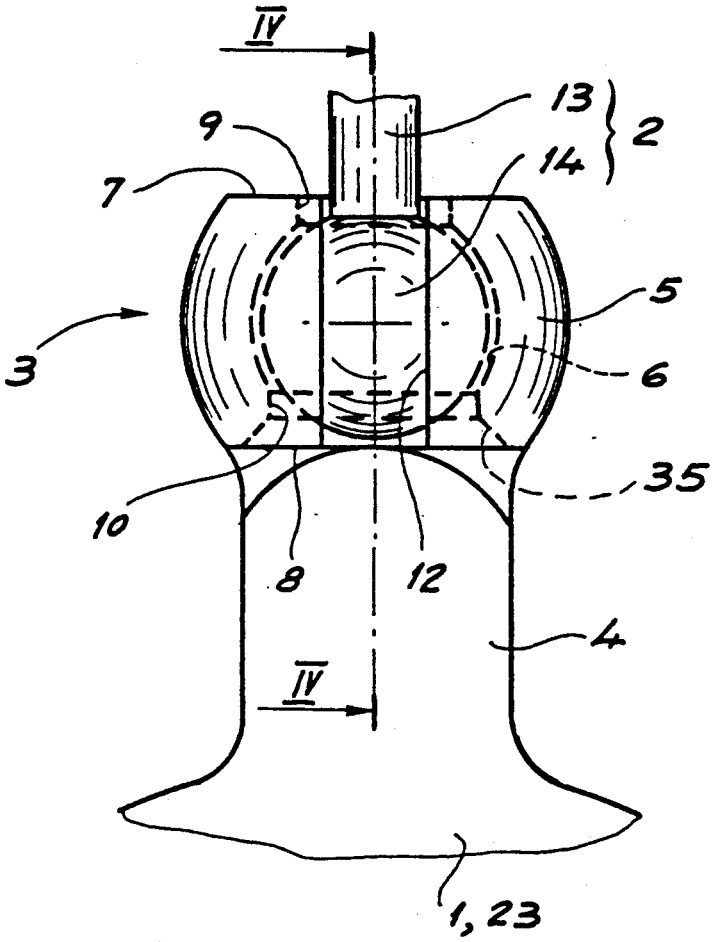
FIG. 3 is a front view of the attaching arrangement proposed in respect of FIGS. 1 and 2 showing the details thereof at an enlarged scale.
Figure 4:
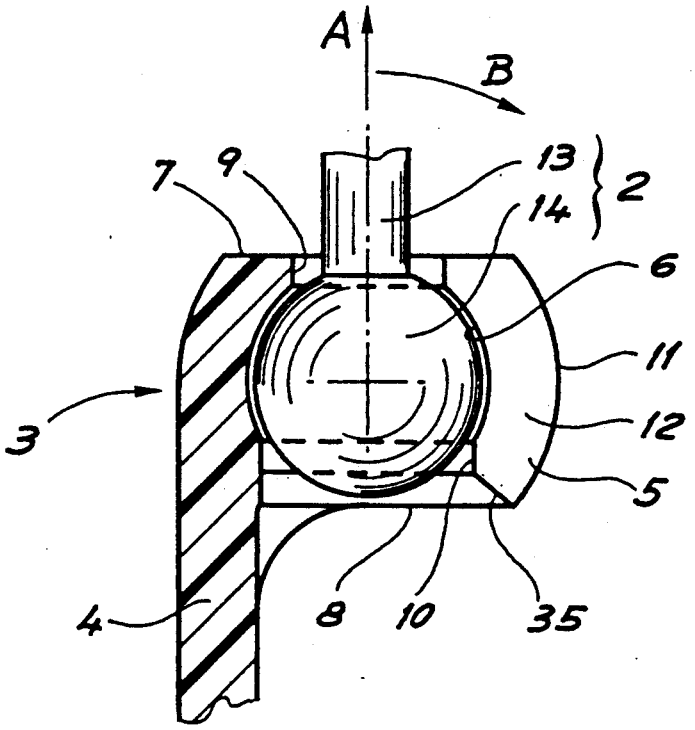
FIG. 4 is a cross-section according to line IV—IV of FIG. 3.

FIGS. 3 and 4 are respectively front and sectional views of the attaching arrangement where have been shown only those means employed by the invention. The case 1 (or receptacle 23) includes a projection 3 in the form of a bracket, the riser 4 of which is fastened to the case 1. Here the figures show that the projection 3 is integrally formed with the case. The cross member 5 of the bracket is hollowed out to provide a spherical housing 6. This housing communicates respectively with the top 7 and the bottom 8 of the cross member by first 9 and second 10 coaxial cylindrical holes. FIGS. 3 and 4 show that the diameters of the first and second cylindrical holes 9 and 10 are substantially smaller than the diameter of the spherical housing 6. The figures further show that the front face 11 of the cross member 5 is provided with a slot 12 which opens at the same time into the spherical housing 6 and into the first and second cylindrical holes.

As to the support 2, this is provided with a stem 13 ending in a ball 14. The diameter of stem 13 is chosen in a manner such that it may be introduced into slot 12. In the same manner, the ball 14 is dimensioned so that it may be forced into the spherical housing following which it may freely move. This implies that the diameter of ball 14 is chosen to be slightly greater than the diameters of the first and second cylindrical holes 9 and 10.

In order to secure the case 1 to its support 2, one begins by passing the stem 13 through slot 12, the ball then being found entirely under the bottom part 8 of cross member 5. When the axis of the stem 13 is approximately aligned with the axis of the cylindrical holes 9 and 10, one may pull on the stem in the sense of arrow A. Ball 14 then penetrates the restriction exhibited by the diameter of the second cylindrical hole 10 by enlarging it slightly from its pasage, this passing enlargement being possible thanks to the elasticity exhibited by the material of which the bracket is formed. The ball is then retained within a spherical housing and may move freely. It will be noted that in order to facilitate entry of the ball 14 one may provide at the lower entry of the cylindrical hole 10 a conical counter-bore 35, which counter-bore may be obliquely elongated to the point of its intersection with the spherical housing 6. In this latter case hole 10 of course no longer exhibits cylindrical walls but only a restriction, at the point of intersection of housing 10 with the counter-bore 35.

In a reverse sense, in order to remove the case from its support, the stem will be rocked in the sense of arrow B to the point where it is turned towards the bottom of the Figure. At this moment one draws on the stem which disengages ball 14 from housing 6 according to the same procedure as that explained hereinabove.

If the cylindrical hole 9 were to be of the same diameter as that of the cylindrical hole 10, one could also introduce the ball or remove it by the upper hole. In the preferred embodiment, it is however arranged that the diameter of hole 9 is substantially less than the diameter of hole 10, hole 10 thus constituting a required passage for the ball. This prevents the watch from being inopportunely separated from the support should one pull on it in the sense of the attachment.

The attaching arrangement which has just been set forth in detail may be applied to various types of supports.

Figure 5:
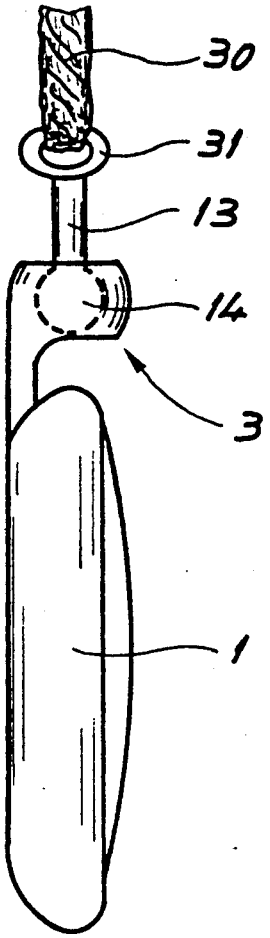
FIG. 5 shows how the invention is employed where the watch is suspended from a chain.

FIG. 5 shows the case where the watch is attached to a chain 30. In this instance the support consists of a stem 13 and a ball 14, this latter being attached to the projection 3 in the manner which has been described hereinabove. Here stem 13 is provided with a buckle 31 which retains chain 30. Such chain could also be mounted on a key holder.

Figure 6:
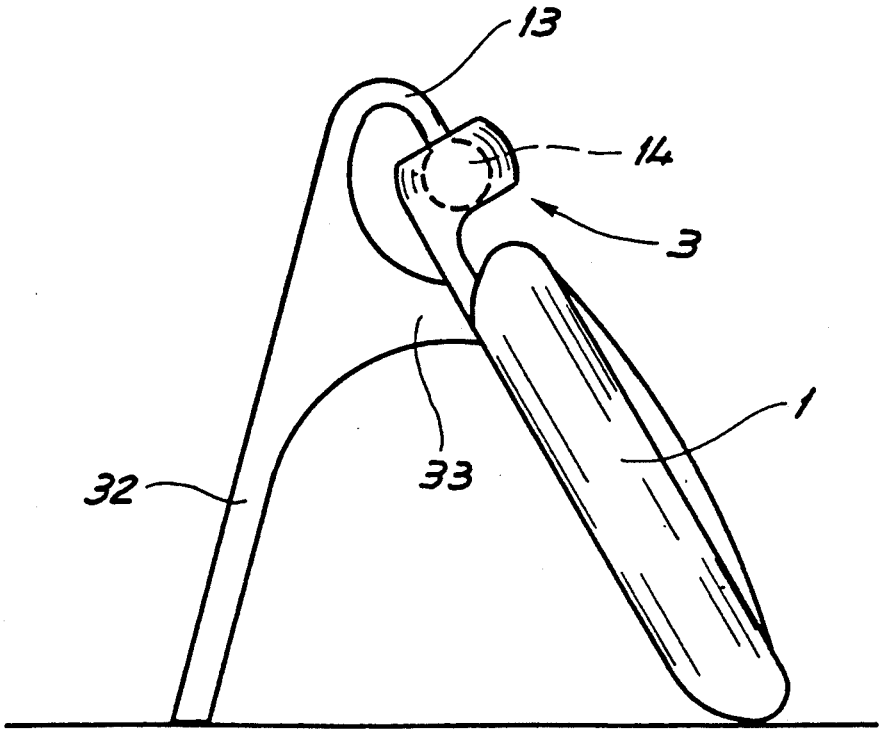
FIG. 6 shows how the attaching arrangement is employed where the watch is held on a stand.

Stem 13 ending in ball 14 could also be the end piece of a stand 32 as may be seen on FIG. 6. Such stand may serve as a presentation stand for a show window or watch support on a work bench. It may be provided with a shoulder 33 intended to determine the angular position of the watch.

What I claim is:

1. An arrangement for removably attaching a watch case to a support, said case comprising a projection in the form of a bracket made of one piece from an elastic material, said bracket including a riser having a first extremity which is fixed to said case and a second extremity which is provided with a cross member projecting perpendicularly from said riser, said cross member being hollowed out to provide a spherical housing communicating respectively with the top and the bottom of said cross member by first and second coaxial cylindrical holes, the diameters of said first and second holes being substantially smaller than that of the spherical housing, the diameter of said first hole being substantially smaller than that of said second hole, said cross member having a free extremity provided with a slot opening respectively into the spherical housing and into said first and second coaxial cylindrical holes, said support having a stem terminating in a ball, said stem being dimensioned so as to be capable of being introduced into said slot and said ball being dimensioned so that it may be introduced by force into said spherical housing via said second cylindrical hole, and thereafter move freely in said spherical housing.

2. An arrangement as set forth in claim 1 wherein said projection in the form of a bracket is fashioned from a plastic material.

3. An arrangement for removably attaching a watch case to a support, said case comprising a projection in the form of a bracket made of one piece from an elastic material, said bracket including a riser having a first extremity which is fixed to said case and a second extremity which is provided with a cross member projecting perpendicularly from said riser, said cross member being hollowed out to provide a spherical housing communicating respectively with the top and the bottom of said cross member by first and second coaxial cylindrical holes, the diameters of said first and second holes being substantially smaller than that of the spherical housing, the diameter of said first hole being substantially smaller than that of said second hole, said cross member having a free extremity provided with a slot opening respectively into the spherical housing and into said first and second coaxial cylindrical holes, said support having a stem terminating in a ball, said stem being dimensioned so as to be capable of being introduced into said slot and said ball being dimensioned so that it may be introduced by force into said spherical housing via said second cylindrical hole, and thereafter move freely in said spherical housing, said stem terminating in a ball comprises the end piece of a watch chain.

* * * * *